US010280883B2

(12) United States Patent
Takahashi

(10) Patent No.: US 10,280,883 B2
(45) Date of Patent: May 7, 2019

(54) FUEL SUPPLY DEVICE

(71) Applicant: AISAN KOGYO KABUSHIKI KAISHA, Obu-shi, Aichi-ken (JP)

(72) Inventor: Hiroyuki Takahashi, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 15/497,347

(22) Filed: Apr. 26, 2017

(65) Prior Publication Data

US 2017/0306906 A1 Oct. 26, 2017

(30) Foreign Application Priority Data

Apr. 26, 2016 (JP) ..... 2016-087972

(51) Int. Cl.
*F02M 37/00* (2006.01)
*F02M 37/10* (2006.01)

(52) U.S. Cl.
CPC ..... *F02M 37/0088* (2013.01); *F02M 37/106* (2013.01)

(58) Field of Classification Search
USPC ..... 123/495, 507–509, 514
See application file for complete search history.

(56) References Cited

U.S. PATENT DOCUMENTS 5,482,444 A * 1/1996 Coha ..... F02M 37/103 248/638
6,206,037 B1 * 3/2001 Murakoshi ..... B60K 15/077 123/509
7,056,102 B2 6/2006 Cremer et al.
8,596,596 B2 * 12/2013 Naji ..... F04D 25/08 248/224.7
8,631,556 B2 1/2014 Pohlmann et al.
8,800,598 B2 * 8/2014 Beyer ..... F02M 37/103 123/509
2005/0058556 A1 * 3/2005 Cremer ..... B60K 15/077 417/363
2007/0221674 A1 * 9/2007 Mori ..... B60K 15/03 220/562
2012/0060949 A1 * 3/2012 Okazono ..... F02M 37/103 137/565.17
2014/0116398 A1 * 5/2014 Jeon ..... F02M 37/0017 123/509

(Continued)

FOREIGN PATENT DOCUMENTS

JP 2002-295327 A 10/2002
JP 2004-204847 A 7/2004
JP 2014-224092 A 12/2014

*Primary Examiner* — John Kwon
*Assistant Examiner* — Johnny H Hoang
(74) *Attorney, Agent, or Firm* — Conley Rose, P.C.

(57) ABSTRACT

A fuel supply device may include a pump case configured to accommodate a fuel pump, a reserve tank, and an elastic support member configured to elastically support the pump case with respect to the reserve tank. The elastic support member is connected to the pump case and the reserve tank via a first connection device and a second connection device, respectively. The first connection device is configured to pivotally connect the elastic support member to the pump case and/or the second connection device is configured to pivotally connect the elastic support member to the reserve tank.

22 Claims, 9 Drawing Sheets

(56) References Cited

U.S. PATENT DOCUMENTS

2015/0059708 A1* 3/2015 Oohashi ..... F02M 37/0088
123/509
2016/0025270 A1* 1/2016 Masaki ..... F17D 1/14
137/565.01

* cited by examiner

FUEL SUPPLY DEVICE

CROSS-REFERENCE TO RELATED APPLICATIONS

The present application claims priority to Japanese Patent Application No. 2016-087972 filed Apr. 26, 2016, which is incorporated herein by reference in its entirety.

STATEMENT REGARDING FEDERALLY SPONSORED RESEARCH OR DEVELOPMENT

Not applicable.

BACKGROUND

The present disclosure relates to a fuel supply device used for supplying fuel stored in a fuel tank to an internal combustion engine.

A known vehicle fuel supply device may generally comprise a pump unit, a cover member and a connection shaft. The pump unit may include a fuel pump and a cup-shaped reserve tank for accommodating the fuel pump. The cover member may be arranged on an upper side of the pump unit. The connection shaft may connect the pump unit and the cover member. The cup-shaped reserve tank of the pump unit may have a bottom wall and an upper opening. The pump unit may further include a pump case for accommodating the fuel pump. The pump case may be disposed within the reserve tank. The connection shaft may protrude upwards from the reserve tank. The cover member may be movable in the vertical direction along the connection shaft while being urged upwards with respect to the pump unit by an elastic member. When the fuel supply device is arranged inside the fuel tank and the cover member is attached to the upper wall of the fuel tank, the urging force of the elastic member may press the pump unit against the bottom wall of the fuel tank, so that the fuel supply device may be fixed in position within the fuel tank.

With the above known fuel supply device, vibrations generated during the operation of the fuel pump may be transmitted in the following order: the fuel pump, the pump case, the reserve tank, and the bottom wall of the fuel tank, or in the following order: the fuel pump, the pump case, the reserve tank, the connection shaft, the cover member, and the upper wall of the fuel tank. Therefore, the vibrations transmitted from the fuel pump may generate noise.

Japanese Laid-Open Patent Publication No. 2004-204847 (also published as US2005/0058556) discloses a vibration isolating fuel pump assembly in which an electric fuel pump fixed to a retainer (corresponding to the pump case) is accommodated in a cup-shaped reservoir (corresponding to the reserve tank) that includes a bottom wall and an upper opening. The retainer is connected to the reservoir via elastic support elements each comprising an elastic connection element a flexible leg portion. The elastic connection element is curved in an S-shape toward the reservoir inner wall. The flexible leg portion extends in the vertical direction from the elastic connection element.

Japanese Laid-Open Patent Application No. 2002-295327 discloses a fuel supply device in which a fuel pump fixed to a unit housing (corresponding to the pump case) is accommodated in a cup-shaped sub tank (corresponding to the reserve tank) that includes a bottom wall and an upper opening. The unit housing is connected to the sub tank via elastic support elements each comprising a support portion formed of a thin resin plate. The support portion extends substantially in the circumferential direction along the outer circumferential surface of the unit housing. The support portion has opposite ends in the extending direction. One of the opposite ends of the support portion is fixed to the outer peripheral surface of the unit housing, and the other of the opposite ends is fixed to the inner peripheral surface of the sub tank.

In both Japanese Laid-Open Patent Publication No. 2004-204847 and Japanese Laid-Open Patent Application No. 2002-295327, opposite ends of each elastic support element are firmly fixed to the pump case and the reserve tank, respectively. Therefore, only an intermediate portion of the elastic support element located between a connection portion including the one end connected to the pump case and a connection portion including the other end connected to the reserve tank can elastically deform for adsorbing vibrations. If an attempt is made to increase the maximum limit of the amplitude of the elastic deformation in order to absorb vibrations having larger amplitudes, it may be necessary to increase the connection distance between the connection portion connected to the pump case and the connection portion connected to the reserve tank. However, increasing the connection distance without changing the capacity of the fuel pump (i.e., the size of the fuel pump) may need to increase the size of the reserve tank, which is rather undesirable in these days where a reduction in size is required.

Therefore, there has been a need in the art for a technique of efficiently absorbing vibrations without need of enlarging the size of the fuel pump and/or the size of the reserve tank.

BRIEF SUMMARY

In one aspect according to the present disclosure, a fuel supply device may include a pump case configured to accommodate a fuel pump, a reserve tank, and an elastic support device configured to elastically support the pump case with respect to the reserve tank. The elastic support device may include an elastic support member and a connection device configured to connect the elastic support member between the pump case and the reserve tank. The connection device may swingably connect the elastic support member to at least one of the pump case and the reserve tank.

With this arrangement, vibrations of the fuel pump may be absorbed by the swinging movement of the elastic support member in addition to the elastic deformation of the same. Therefore, it is possible to efficiently mitigate the vibrations without need of increasing the size of the reserve tank and/or the size of the pump case.

In one embodiment, the connection device may include a first connection device configured to connect a first portion of the elastic support member to the pump case, and a second connection device configured to connect a second portion of the elastic support member to the reserve tank. The first connection device may connect the first portion of the elastic support member to the pump case such that the first portion is swingable relative to the pump case about a swinging axis. Additionally or alternatively, the second connection device may connect the second portion of the elastic support member to the reserve tank such that the second portion is swingable relative to the reserve tank about a swinging axis;

In another embodiment, the elastic support member may have a plate shape having a thickness direction, and the swinging axis may be substantially perpendicular to the thickness direction of the elastic support member at the first portion or the second portion. The elastic support portion may have an intermediate portion between the first portion and the second portion, and the intermediate portion may be bent in the thickness direction thereof. With this arrangement, it is possible to efficiently mitigate the vibrations by a simple construction.

In a further embodiment, the first connection device may include a connection portion disposed at the first portion of the elastic support member and a support portion disposed at the pump case. Additionally or alternatively, the second connection device may include a connection portion disposed at the second portion of the elastic support member and a support portion disposed at the reserve tank. One of the connection portion and the support portion may comprise a substantially cylindrical columnar portion. The other of the connection portion and the support portion may comprise a substantially cylindrical hole for rotatably receiving the substantially cylindrical columnar portion about the swinging axis or may comprise a groove having a shape substantially corresponding to a part of a cylindrical hole for rotatably receiving the substantially cylindrical columnar portion about the swinging axis. With this arrangement, it is possible to ensure that the elastic support member can smoothly swing relative to the pump case and/or the reserve tank.

In a further embodiment, the first connection device may swingably connect the first portion of the elastic support member to the pump case about a point. Additionally or alternatively, the second connection device may swingably connect the second portion of the elastic support member to the reserve tank about a point. With this arrangement, the first connection device and/or the second connection device may constitute a joint structure similar to a ball joint. Therefore, the elastic connection member can swing in various directions to further mitigate transmission of vibrations from the fuel pump to the reserve tank.

DETAILED DESCRIPTION

Figure 1:
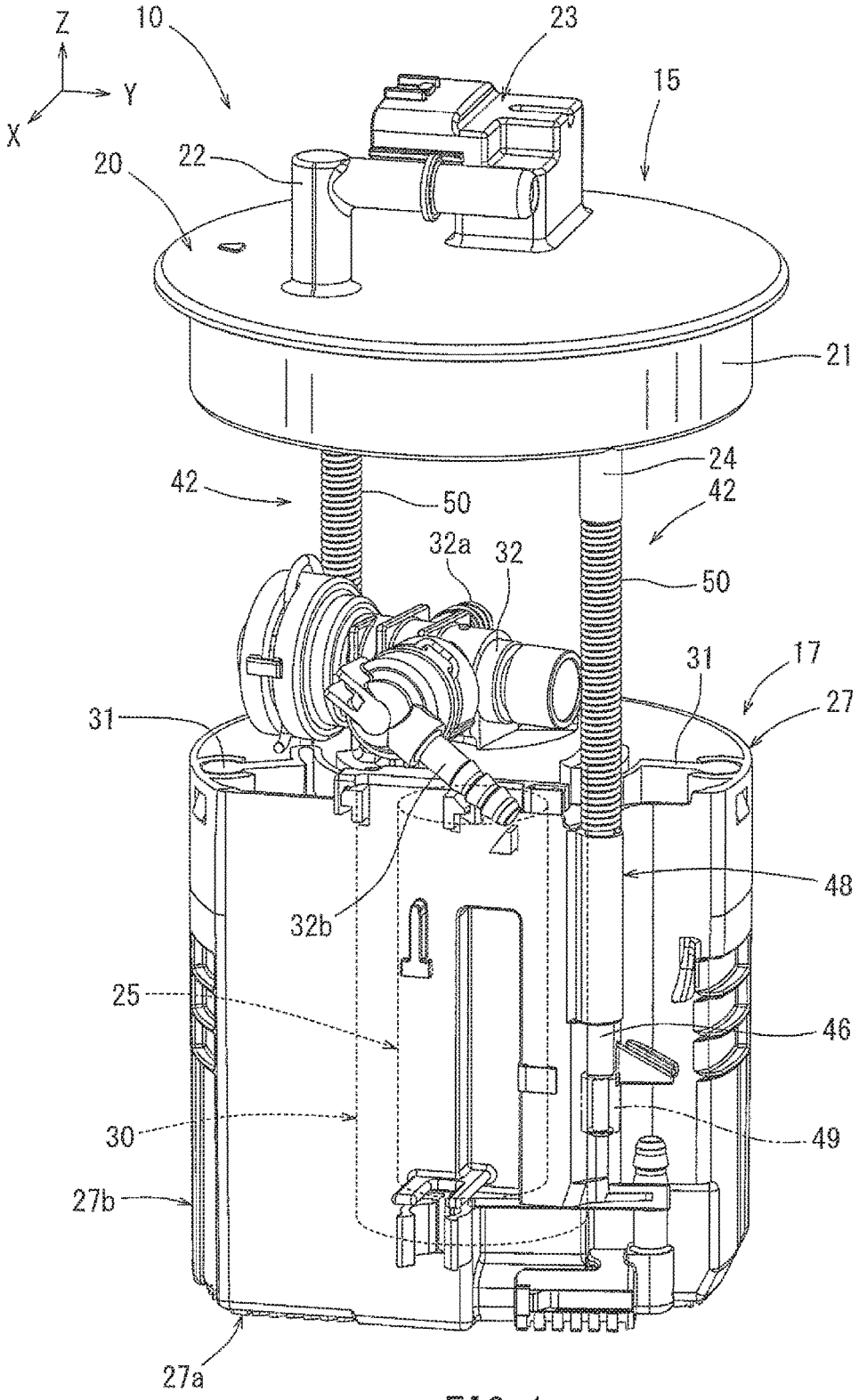
FIG. 1 is a perspective view of a fuel supply device according to a representative embodiment.

Each of the additional features and teachings disclosed above and below may be utilized separately or in conjunction with other features and teachings to provide improved fuel supply devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

Embodiments will now be described with reference to the drawings. X-axis, Y-axis, and Z-axis orthogonal to each other are show in the drawings. The X-axis and the Y-axis indicate directions within a horizontal plane, and the Z-axis indicates a vertically upward direction.

A fuel supply device according to a representative embodiment is designed for supplying fuel stored in a fuel tank to an internal combustion engine of a vehicle such as an automobile or a motorcycle.

Referring to FIG. 1, a fuel supply device 10 may be installed within a fuel tank (not shown) of a vehicle. The fuel supply device 10 may generally include a pump unit 17, a flange unit 15 arranged above the pump unit 17, and a pair of connection mechanisms 42 for connecting the pump unit 17 and the flange unit 15. The flange unit 15 can move vertically in the Z-axis direction that is parallel to the longitudinal directions of the connection mechanisms 42. Each of the connection mechanisms 42 may include an elastic member 50 (such as a coil spring) that normally bias the flange unit 15 upwards with respect to the pump unit 17. The fuel tank may be a hollow resin container and may include an upper wall and a bottom wall extending substantially parallel to each other. The upper wall may include an opening, such as a circular hole, to which the flange unit 15 can be fixedly attached. When the flange unit 15 is fixed to the opening of the fuel tank, the pump unit 17 may be pressed against the upper surface of the bottom wall of the fuel tank by the biasing force of the elastic members 50. In this way, the pump unit 17, more specifically the reserve tank 27 that will be explained later may be fixed in position relative to the bottom wall of the fuel tank.

The flange unit 15 may be formed, for example, of resin, and may include a circular disc-shaped flange 20 for closing the opening of the fuel tank. On the lower surface of the flange 20, there is concentrically formed a fit-engagement tubular portion 21 having a relatively short cylindrical tubular shape. The outer diameter of the fit-engagement tubular portion 21 is slightly smaller than the outer diameter of the flange 20. A fuel discharge pipe 22 and an electric connector 23 may be mounted to the flange 20. The flange unit 15 can be attached to the upper wall of the fuel tank so as to close the opening through engagement of the fit-engagement tubular portion 21 with the opening.

The pump unit 17 may generally include a fuel pump 25 for pressurizing (pumping) the fuel, a pump case 30 for accommodating the fuel pump 25, and a reserve tank 27 for accommodating the pump case 30. The fuel pump 25 may have a substantially cylindrical columnar shape and may include a fuel inlet port and a fuel discharge port (not shown) respectively disposed at the top and the bottom thereof. The fuel may be drawn into the fuel pump 25 via the fuel inlet port and may be discharged from the fuel discharge port after being pressurized. The fuel pump 25 may further include an electric connector (not shown) that may be electrically connected to the electric connector 23 of the flange unit 15 via a wiring member (not shown). A fuel delivery device 32 may be connected to the fuel discharge port of the fuel pump 25. The fuel delivery device 32 includes a first discharge pipe 32*a* and a second discharge pipe 32*b*. The first discharge pipe 32*a* is connected to the fuel discharge pipe 22 of the flange unit 15 via a piping member (not shown) that may be a bellows-like hose or the like. The second discharge pipe 32*b* may be connected to a jet pump (not shown). Although not shown in the drawings, a pressure regulator, a suction filter including a filtering member, etc. that may be generally associated in this kind of fuel pump may be also connected to the fuel pump 25. The pump case 30 may be made, for example, of resin, and may have a substantially cylindrical tubular shape for accommodating the fuel pump 25 that has a substantially cylindrical columnar shape as described above.

The reserve tank 27 may be made, for example, of resin, and may have a cup shape that is a bottomed cylindrical tubular shape with an upper opening. More specifically, the reserve tank 27 may have a bottom wall 27*a* and a circumferential wall 27*b*. Further, the pump case 30 may be elastically supported by the reserve tank 27 via a plurality of elastic support members 31.

The pair of connection mechanisms 42 connect the flange unit 15 and the pump unit 17 such that the flange unit 15 and the pump unit 17 can move vertically relative to each other. In addition to the elastic member 50 (coil spring or the like), each of the connection mechanisms 42 may include a press-fitting portion 24 provided on the flange unit 15, an insertion portion 48 provided on the reserve tank 27, a connection shaft 46, and a stopper member 49. The press-fitting portion 24 may be molded integrally with the fit-engagement tubular portion 21, and the upper end of the connection shaft 46 is press-fitted into the press-fitting portion 24. The elastic member 50 may be fitted on the connection shaft 46 after the upper end of the connection shaft 46 is press-fitted into the press-fitting portion 24. Subsequently, the connection shaft 46 may be slidably inserted into the insertion portion 48 molded integrally with the reserve tank 27, and after that, the stopper member 49 may be mounted to the lower end of the connection shaft 46.

The fuel pump 25 may generate vibrations during its operation and may serve as a main vibration source of the fuel supply device 10. The vibrations of the fuel pump 25 may be transmitted to the pump case 30 and may be further transmitted from the pump case 30 to the reserve tank 27 via the plurality of elastic support members 31. In some cases, the vibrations transmitted to the reserve tank 27 may cause vibrations of the bottom wall of the fuel tank to generate noise. Further, the vibrations transmitted to the reserve tank 27 may be transmitted to the flange unit 15 via the connection mechanisms 42. In some cases, the vibrations transmitted to the flange unit 15 may cause vibrations of the upper wall of the fuel tank to generate noise.

According to the representative embodiment, a connection structure between the pump case 30 and each of the elastic support members 31, and/or a connection structure between each of the elastic support members 31 and the reserve tank 27 is(are) configured to further mitigate the vibrations transmitted from the fuel pump 25 to the reserve tank 27. First through tenth embodiments relating to these connection structures will be hereinafter described. For ease of illustration, in the first through ninth embodiments, each of pump cases corresponding to the pump case 30 is shown to have a cylindrical tubular shape, and each of reserve tanks corresponding to the reserve tank 27 is shown to have a bottomed cylindrical tubular shape with an upper opening. Further, in the following description, the end portion of each of elastic support members corresponding to the elastic support members 31 and connected to the reserve tank will be referred to as the "tank side end portion" and the end portion of each of the elastic support members connected to the pump case will be referred to as the "case side end portion."

Figure 2:
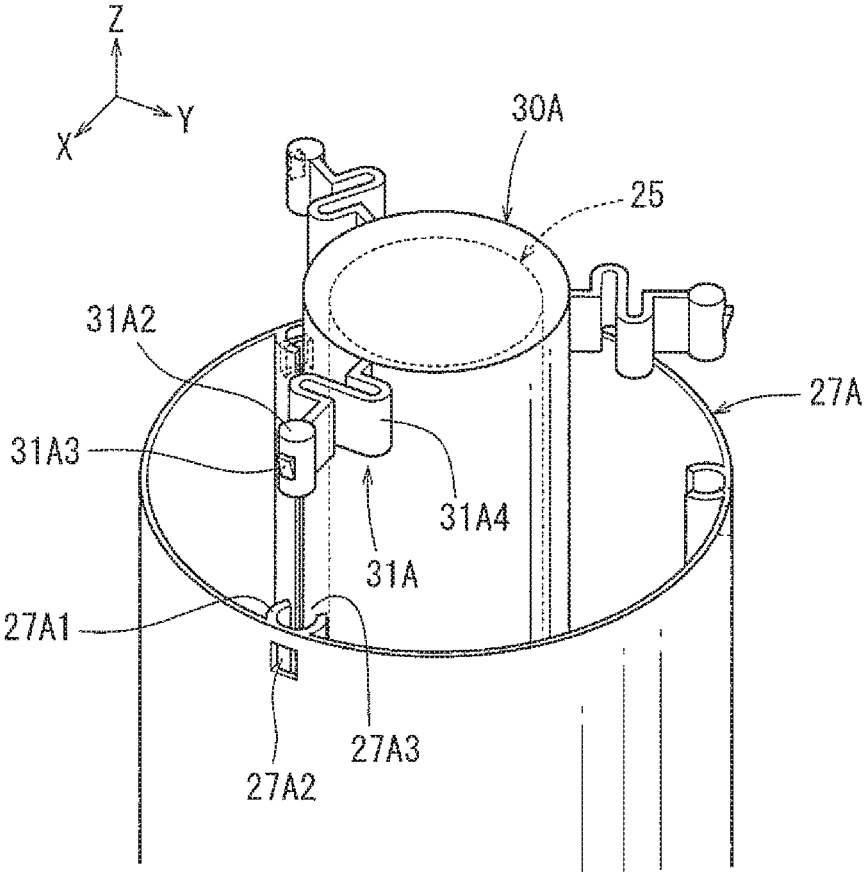
FIG. 2 is a perspective view of a swingable connection structure between a pump case and a reserve tank according to a first embodiment.
Figure 3:
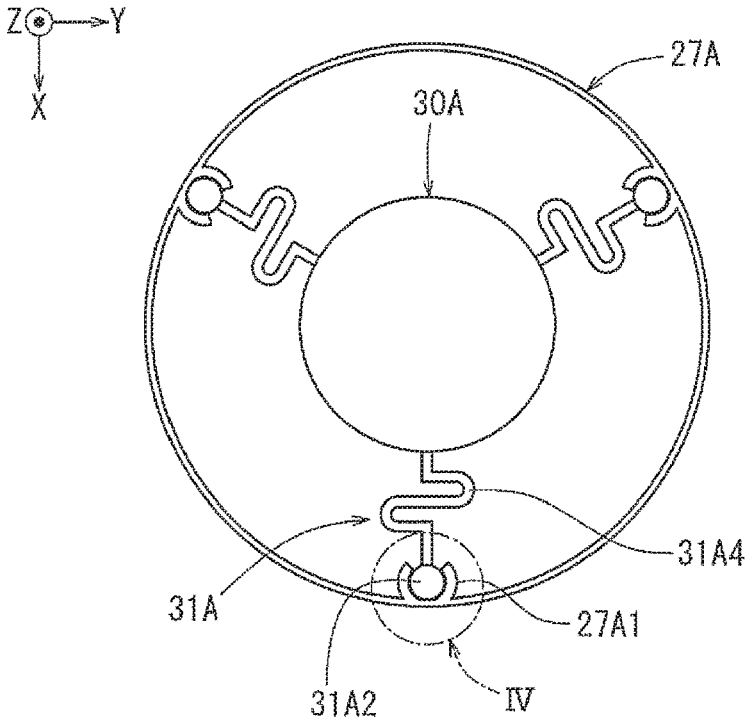
FIG. 3 is a plan view of the swingable connection structure according to the first embodiment.

A first embodiment will now be described with reference to FIGS. 2 through 5. Referring to FIGS. 2 and 3, a case side end portion of each of a plurality of elastic support members 31A (corresponding to the elastic support member 31) is fixed to a pump case 30A (corresponding to the pump case 30). On the other hand, a tank side end portion of each of the elastic support members 31A has a connection portion 31A2 that can be inserted into corresponding one of a plurality of support portions 27A1 provided on a reserve tank 27A (corresponding to the reservoir tank 27). As explained in connection with the representative embodiment, the reserve tank 27A may be fixed in position relative to the bottom wall of the fuel tank. For example, the case side end portions of the elastic support members 31A may be fixedly attached to the pump case 30A or may be formed integrally with the pump case 30A. Similarly, the support portions 27A1 may be fixedly attached to the reserve tank 27A or may be formed integrally with the reserve tank 7A. In this embodiment, three elastic support members 31A are arranged to be spaced equally from each other in the circumferential direction about the pump case 30A. Similarly, three support portions 27A1 are arranged to be spaced equally from each other in the circumferential direction of the reserve tank 27A to correspond to the elastic support members 31A. The three elastic support members 27A1 may have the same construction, and the three support portions 27A1 may have the same construction. Therefore, in the following one of the elastic support members 31A1 and its corresponding support portion 27A1 will be described.

The elastic support member 31A may have a plate shape and may be formed of an elastically deformable material such as resin. As the elastic support member 31A extends from the pump case 30A toward the reserve tank 27A, it is bent in the thickness direction so as to be curved into an S-shape as seen from above at an intermediate portion 31A4. The connection portion 31A2 has a substantially cylindrical columnar configuration, the axis of which extends in the Z-axis direction. The connection portion 31A2 includes a pawl portion 31A3 formed on a part of the outer circumferential surface of the connection portion 31A2 facing the inner circumferential surface of the reserve tank 27A. The height, i.e., the radially protruding distance, of the pawl portion 31A3 gradually increases in the upward direction. The connection portion 31A2 can be connected to the corresponding support portion 27A1 provided on (formed on or attached to) the inner circumferential surface of the reserve tank 27A such that the elastic support member 31A can make a swinging motion, i.e., a pivotal motion, about the support portion 27A1.

Figure 4:
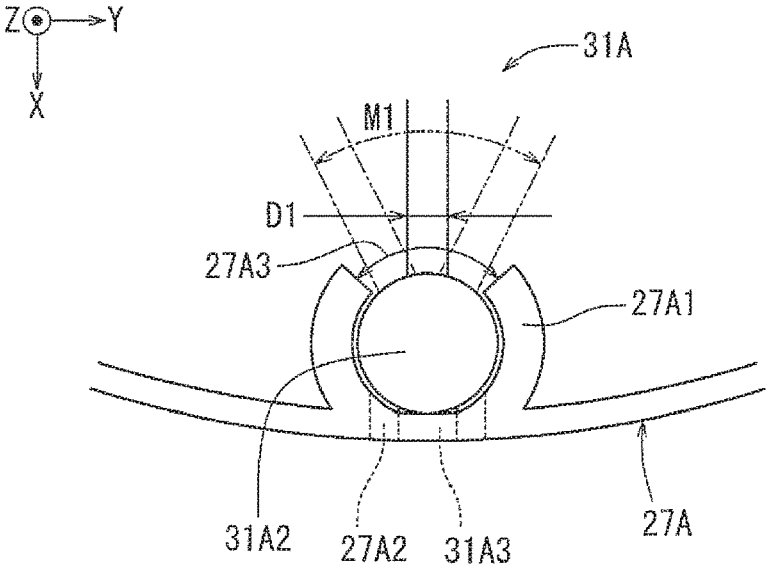
FIG. 4 is an enlarged view of a region IV in FIG. 3, illustrating a swingable operation performed by the swingable connection structure.

As shown in FIG. 4, the support portion 27A1 may have a substantially U-shape corresponding to a cylindrical tube with a part located on the radially inner side of the reserve tank 27A being cut-out. Thus, the support portion 27A1 has a longitudinal axis in the Z-axis direction and is provided with a cutout portion 27A3 extending in the Z-axis direction. The size of the cutout portion 27A3 is determined so as to prevent potential interference with a part of the elastic support member 31A extending from the connection portion 31A2, while allowing rotation of the connection portion 31A2 about its axis within the support portion 27A1. Further, in this connection, as shown in FIG. 2, an opening 27A2 for engagement with the pawl portion 31A3 may be formed in the circumferential wall of the reserve tank 27A to extend therethrough in the radial direction at a position proximal to the upper end of the support portion 27A1. In order to allow the swinging motion (see FIG. 4) of the elastic support member 31A, the width in the circumferential direction of the opening 27A2 is set to be larger than the width of the pawl portion 31A3 in the same direction. Further, in order to allow the swinging motion (see FIG. 4) of the elastic support member 31A, the width in the circumferential direction of the cutout portion 27A3 is set to be larger than thickness D1 of the elastic support member 31A (see FIG. 4). In this way, the support portion 27A1 supports the elastic support member 31A such that the elastic support member 31A can make the swinging motion about the rotation axis of the connection portion 31A2, which coincides with the longitudinal axis of the support portion 27A1.

As shown in FIG. 2, the connection portions 31A2 may be inserted into the corresponding support portions 27A1 from above, so that the pawl portion 31A3 provided on the outer circumferential surface of each connection portion 31A2 can be engaged with (inserted into) the corresponding openings 27A2, whereby the elastic support members 31A can be fixed in position with respect to the Z-axis direction.

As described above, the support portion 27A1 and the connection portion 31A2 may serve as a swingable connection structure allowing the swinging motion of the elastic support member 31A relative to the reserve tank 27A. The swinging direction of the elastic support member 31A is a circumferential direction about the longitudinal axis of the connection portion 31A2 and may substantially coincide with the direction of the thickness D1 of a part of the elastic support member 31A located proximal to the swingable connection structure as shown in FIG. 4. The range M1 within which each elastic support member 31A can swing may be restricted by the width of the cutout portion 27A3 or by the width of the opening 27A2.

Figure 5:
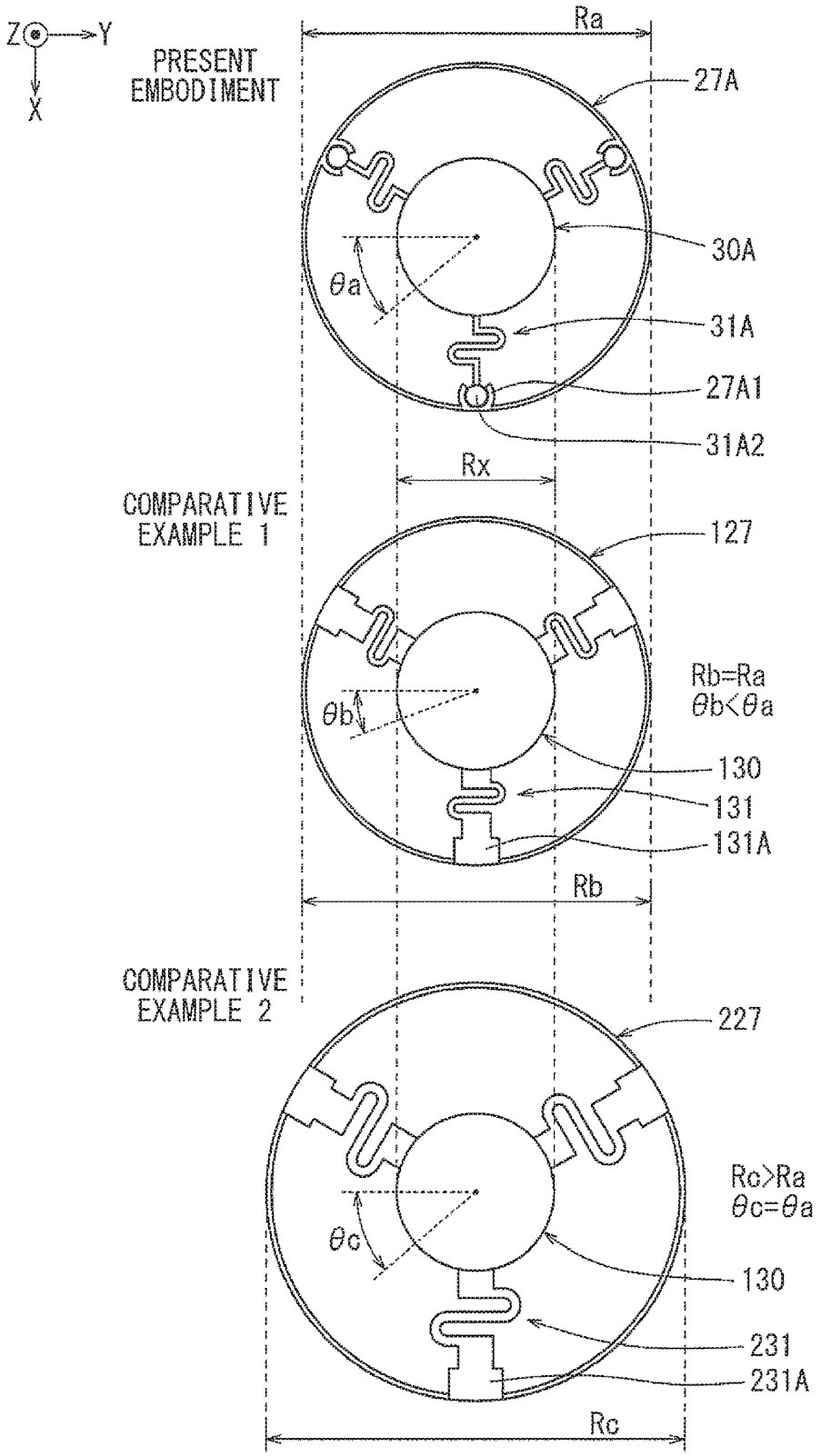
FIG. 5 is a comparison diagram illustrating the relationship between a maximum swingable angle (corresponding to a maximum amplitude of the swinging motion allowed by an elastic support member) and a diameter of a reserve tank according to the first embodiment, the relationship between the maximum swingable angle according to a first comparative example, and the relationship between the same according to a second comparative example.

FIG. 5 shows the swingable connection structures of elastic support members 31A according to the first embodiment in comparison with connecting structures of elastic support members 131 according to a first comparative example and in comparison with connecting structures of elastic support members 231 according to a second comparative example. The swingable connection structures according to the first embodiment shown in the upper portion of FIG. 5 allows rotation of the pump case 30A relative to the reserve tank 27A up to an angle θa (hereinafter also called a "maximum rotatable range θa"). The angle θa is determined by the elastically deformable range of the elastic support members 31A and by the swingable range allowed by the swingable connection structure. In this upper portion of FIG. 5, the reserve tank 27A has an outer diameter Ra.

The middle portion of FIG. 5 shows the connecting structures of the first comparative example. In this first comparative example, an outer diameter Rb of a reserve tank 127 is set to be the same as the outer diameter Ra of the reserve tank 27A of the first embodiment. Each of the elastic support members 131 of the first comparative example has opposite ends that are firmly fixed (i.e., non-swingably or non-pivotally attached) to a pump case 130 and the reserve tank 127, respectively. The diameter of the pump case 130 is the same as the diameter Rx of the pump case 30A of the first embodiment. In this case, if the elastically deformable range of each elastic support member 131 is the same as each of the elastic support members 31A, a maximum rotatable angle θb allowed by the first comparative example is smaller than the maximum rotatable angle θa allowed by the first embodiment, because the connecting structures of the first comparative example includes no swingable connection portions. That is, as compared with the connection structures of the first comparative example, the swingable connection structures of the first embodiment can efficiently mitigate the vibrations transmitted to the reserve tank.

The lower portion of FIG. 5 shows the connecting structures of the elastic support members 231 of the second comparative example. In this second comparative example, an outer diameter Rc of a reserve tank 227 is set to be larger than the outer diameter Ra of the reserve tank 27A of the first example. Each of the elastic support members 231 of the second comparative example has opposite ends that are firmly fixed (non-swingably or non-pivotally attached) to the pump case 130 and the reserve tank 227, respectively. As compared with the structures shown in the upper portion (first example) and the middle portion (first comparative example) of FIG. 5, the structure shown in the lower portion (second comparative example) of FIG. 5 is increased in the radial distance (i.e., the size of the space in the radial direction) from the outer circumferential surface of the case 130 to the inner circumferential surface of the reserve tank 227. The increased radial distance (i.e., the increased size of the space in the radial direction) allows an increase in the length (the length as measured along the extending path) of the elastic support members 231. Therefore, a maximum rotatable angle θc allowed by the elastic support members 231 of the second comparative example may be set to be equivalent to the maximum rotatable angle θa allowed in the first embodiment. However, the second comparative example is not preferable because the outer diameter of the reserve tank 227 becomes rather large.

As described above, the first embodiment of the present disclosure is advantageous over the first and second comparative examples in that it is possible to achieve a large maximum rotatable angle (i.e., the maximum rotatable angle θa) of the pump case 30A with respect to the reserve tank 27A by a simple construction without need of increasing the size of the pump case 30A. As a result, it is possible to efficiently mitigate vibrations that may be transmitted from the fuel pump 25 to the reserve tank 27A.

Figure 6:
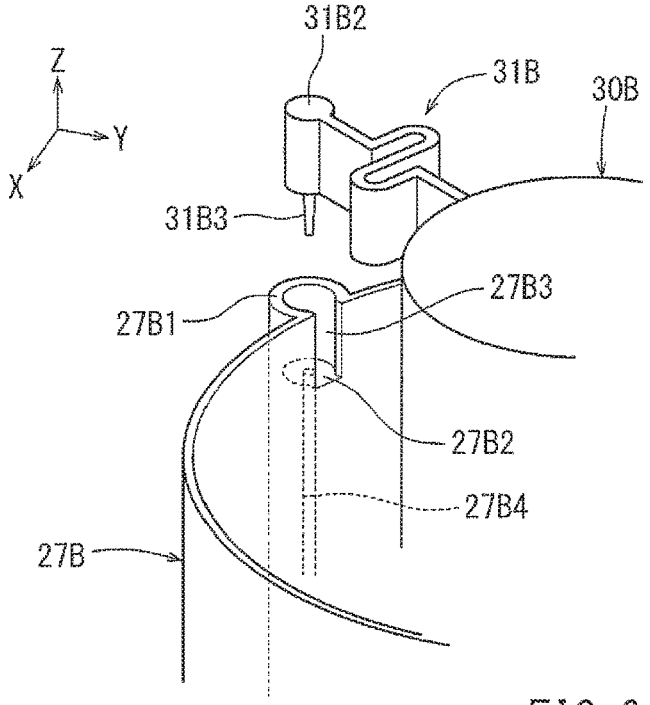
FIG. 6 is a perspective view illustrating a swingable connection structure between a pump case and a reserve tank according to a second embodiment.

Next, referring to FIG. 6, there is shown a swingable connection structure according to a second embodiment, which includes a plurality of elastic support members 31B (corresponding to the elastic support member 31 and only one elastic support member 31B is shown in FIG. 6) for connecting between a pump case 30B (corresponding to the pump case 30) and a reserve tank 27B (corresponding to the reserve tank 27). The elastic support members 31B shown in FIG. 6 are different from the elastic support members 31A shown in FIG. 2 (the first embodiment) in that a connection portion 31B2 of each of the elastic support members 31B does not include the pawl portion 31A but includes a pin portion 31B3 protruding downward from the lower end of the connection portion 31B2. Further, a plurality of support portions 27B1 (only one support portion 27B1 is shown in FIG. 6) are provided on the reserve tank 27B. The support portions 27B1 are different from the support portions 27A1 of the reserve tank 27A shown in FIG. 2 in that each of the support portions 27B1 does not include the opening 27A2 but includes a bottom portion 27B2 and an axial hole 27B4 that will be explained later. Similar to the first embodiment, the case side end portion of each of the elastic support members 31B is fixed to the pump case 30B, and an intermediate portion of each elastic support member 31B is curved into an S-shape. Therefore, in the following, the description will be focused on the differences from the first embodiment. Further, the swingable connection structure will be described for only one of the elastic support members 31B and its corresponding support portion 27B1.

As shown in FIG. 6, the elastic support member 31B includes a substantially cylindrical columnar connection portion 31B2 disposed at the tank side end portion. The connection portion 31B2 has a longitudinal axis that extends in the Z-axis direction. The pin portion 31B3 protrudes downward from the lower end of the connection portion 31B2. The connection portion 31B2 can be connected to the corresponding support portion 27B1 such that the elastic support member 31B can make a swinging motion with respect to the support portion 27B1.

The support portion 27B1 of the reserve tank 27B has a substantially cylindrical columnar shape extending in the Z-axis direction and formed on an outer circumferential side of the reserve tank 27B. The upper portion of the support portion 27B has a substantially cylindrical tubular shape and includes a cutout portion 27B3 opened at the inner circumference of the reserve tank 27B and extending in the Z-axis direction. Therefore, the upper portion of the support portion 27B1 is opened at its upper end and also on its lateral side via the cutout portion 27B3 and is closed at the bottom portion 27B1. The upper portion of the support portion 27B is configured to rotatably receive the connection portion 31B2 about its longitudinal axis, i.e., the axis parallel to the Z-axis. The cutout portion 27B3 may allow the elastic support member 31B to make a swinging motion within a predetermined angular range (i.e., a maximum angle range). Further, the bottom surface 27B2 of the upper portion of the support portion 27B1 is configured to support the lower end of the connection portion 31B2 from below in the Z-axis direction. The axial hole 27B4 is formed in the bottom surface 27B2 in the axial direction, i.e., the Z-axis direction. The pin portion 31B3 can be inserted into the axial hole 27B4 such that the pin portion 31B3 can rotate within the axial hole 27B4 to allow the swinging motion of the elastic support member 31B. Similar to the first embodiment, the width in the circumferential direction of the cutout portion 27B3 is set to be larger than the thickness of the elastic support member 31B. In this way, the support portion 27B1 can support the elastic support member 31B so as to allow the swinging motion about the longitudinal axis of the support portion 27B1.

As shown in FIG. 6, the connection portion 31B2 may be inserted into the upper portion of the support portion 27B1 from above so that the pin portion 31B3 may be inserted into the axial hole 27B4 until the lower end surface of the connection portion 31B2 contacts the bottom portion 27B2. As a result, the elastic support member 31B can be positioned with respect to the Z-axis direction, so that the pump case 30B can be positioned with respect to the Z-axis direction.

In this way, the support portion 27B1 and the connection portion 31B2 may constitute the swingable connection structure that allows a swinging motion of the elastic support member 31B with respect to the reserve tank 27B. Further, similar to the first embodiment, the swinging direction of the swingable connection structure may substantially coincides with the thickness direction of a part of the elastic support member 31B positioned proximal to the swingable connection structure. Further the swinging direction is a circumferential direction about the longitudinal axis (central axis) of the connection portion 31B2. The range within which the elastic support member 31B can swing (i.e., the maximum rotatable angle of the connection portion 31B2) may be defined by the width of in the circumferential direction of the cutout portion 27B3.

Figure 7:
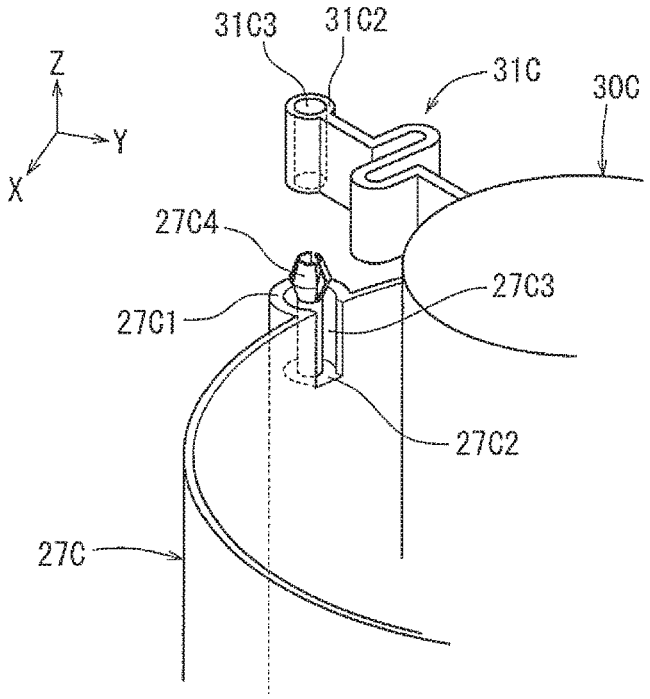
FIG. 7 is a perspective view illustrating a swingable connection structure between a pump case and a reserve tank according to a third embodiment.

Next, referring to FIG. 7, there is shown a swingable connection structure according to a third embodiment, which includes a plurality of elastic support members 31C (corresponding to the elastic support member 31 and only one elastic support member is shown in FIG. 7) for connecting between a pump case 30C (corresponding to the pump case 30) and a reserve tank 27C (corresponding to the reserve tank 27). The elastic support members 31C are different from the elastic support members 31A shown in FIG. 2 (the first embodiment) in that a connection portion 31C2 of each of the elastic support members 31C does not include the pawl portion 31A but includes a through-hole 31C3 formed in the connection portion 31C2 and extending in the axial direction of the connection portion 31C2. Further, a plurality of support portions 27C1 (only one support portion 27C1 is shown in FIG. 7) are provided on the reserve tank 27C. The support portions 27C1 are different from the support portions 27A1 of the reserve tank 27A shown in FIG. 2 in that each of the support portions 27C1 does not include the opening 27A2 but includes a bottom portion 27C2 and a snap-fit portion 27C4 that will be explained later. Similar to the first embodiment, the case side end portion of each of the elastic support members 31C is fixed to the pump case 30C, and an intermediate portion of each of the elastic support members 31C is curved into an S-shape. Therefore, in the following, the description will be focused on the differences from the first embodiment. Further, the swingable connection structure will be described for only one of the elastic support members 31C and its corresponding support portion 27C1.

Referring to FIG. 7, the connection portion 31C2 (i.e., the tank side end portion) of the elastic support members 31C has a substantially cylindrical tubular shape having a longitudinal axis extending in the Z-axis direction. The through-hole 31C3 is formed in the connection portion 31C2 to extend therethrough in the Z-axis direction. The connection portion 31C2 can be connected to the support portion 27C1 such that the elastic support member 31C can make a swinging motion with respect to the support portion 27C1 as will be explained below.

The support portion 27C1 of the reserve tank 27C has a substantially cylindrical columnar shape extending in the Z-axis direction and formed on an outer circumferential side of the reserve tank 27C. The upper portion of the support portion 27C has a substantially cylindrical tubular shape and includes a cutout portion 27C3. The cutout portion 27C3 is opened at the inner circumference of the reserve tank 27C and extends in the Z-axis direction. Therefore, the upper portion of the support portion 27C1 is opened at its upper end and also on its lateral side via the cutout portion 27C3 and is closed at the bottom portion 27C2. The upper portion of the support portion 27C1 is configured to rotatably receive the connection portion 31C2 about its longitudinal axis, i.e., the axis parallel to the Z-axis. The cutout portion 27C3 may allow the elastic support member 31C to make a swinging motion within a predetermined angular range (i.e., a maximum angular range). Further, the bottom surface 27C2 of the upper portion of the support portion 27C1 is configured to support the lower end of the connection portion 31C2 from below in the Z-axis direction. The snap-fit portion 27C4 protrudes upward from the bottom portion 27C2. The upper end of the snap-fit portion 27C4 is split into a plurality of radially elastically deformable portions arranged in the circumferential direction. The plurality of radially elastically deformable portions jointly constitute a diameter variable portion having a variable maximum diameter. When no load is applied to the diameter variable portion, the maximum diameter of the diameter variable portion may be larger than the diameter of the through-hole 31C3. When a load is applied to the diameter variable portion in the radial direction, the maximum diameter may be reduced to be smaller than the diameter of the through-hole 31C3 as will be explained later. Similar to the first embodiment, the width in the circumferential direction of the cutout portion 27C3 is set to be larger than the thickness of the elastic support member 31C. The support portion 27C1 configured in this way can support the elastic support member 31C such that the elastic support member 31C can make a swinging motion about the longitudinal axis (central axis) of the support portion 27C.

As shown in FIG. 7, the connection portion 31C2 may be inserted into the support portion 27C1 from above, so that the snap-fit portion 27C4 is inserted into the through-hole 31C3 of the connection portion 31C2. At the beginning of the insertion of the snap-fit portion 27C4 into the through-hole 31C3, the diameter variable portion at the upper end of the snap-fit portion 27C4 may first contact the edge portion of the lower opening of the through-hole 31C3. As the snap-fit portion 27C4 moves further into the through-hole 31C3, the diameter variable portion may elastically deform to reduce its maximum diameter due to the interaction with the edge portion of the lower opening of the through-hole 31C3. Therefore, the diameter variable portion may have the maximum diameter that may be substantially equal to or smaller than the inner diameter of the through-hole 31C3. In this way, the diameter variable portion can move axially through the through-hole 31C3. The inserting movement of the snap-fit portion 27C4 may be stopped when the lower end of the connection portion 31C2 contacts the bottom portion 27C2 of the support portion 27C1, so that the elastic support member 31C can be positioned with respect to the Z-axis direction. At the same time, the diameter variable portion at the upper end of the snap-fit portion 27C4 may protrude upward from the upper end of the connection portion 31C2 after passing through the through-hole 31C3. Therefore, the diameter variable portion may be restored to have the maximum diameter that is larger than the diameter of the through-hole 31C3. As a result, the connection portion 31C2 may be prevented from being removed from the support portion 27C1.

In this way, the support portion 27C1 and the connection portion 31C2 may constitute the swingable connection structure that allows a swinging motion of the elastic support member 31C with respect to the reserve tank 27C. Further, similar to the first embodiment, the swinging direction of the swingable connection structure may substantially coincides with the thickness direction of a part of the elastic support member 31C positioned proximal to the swingable connection structure. Further the swinging direction is a circumferential direction about the longitudinal axis (central axis) of the connection portion 31C2. The range within which the elastic support member 31C can swing (i.e., the maximum rotatable angle of the connection portion 31C2) may be defined by the width of in the circumferential direction of the cutout portion 27C3.

Figure 8:
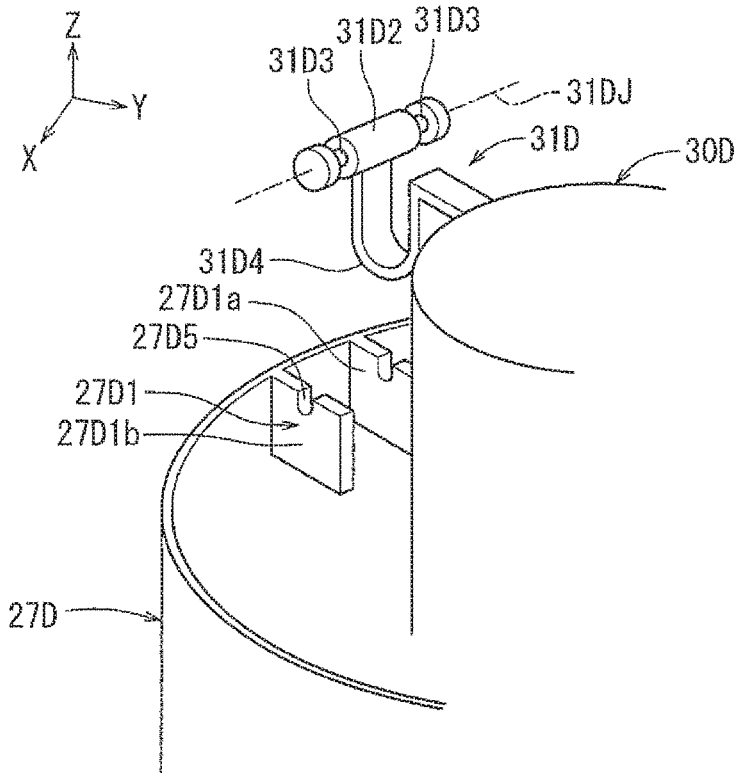
FIG. 8 is a perspective view illustrating a swingable connection structure between a pump case and a reserve tank according to a fourth embodiment.

Next, referring to FIG. 8, there is shown a swingable connection structure according to a fourth embodiment, which includes a plurality of elastic support members 31D (corresponding to the elastic support member 31 and only one elastic support member is shown in FIG. 8) for connecting between a pump case 30D (corresponding to the pump case 30) and a reserve tank 27D (corresponding to the reserve tank 27). The elastic support members 31D of the fourth embodiment are different from the elastic support member 31A shown in FIG. 2 (the first embodiment) in their constructions and their swinging direction. Further, a plurality of support portions 27D1 (only one support portion 27D1 is shown in FIG. 8) are provided on the reserve tank 27D. The support portions 27D1 are configured differently from the support portions 27A1 of the reserve tank 27A shown in FIG. 2. However, similar to the first embodiment, the case side end portion of each of the elastic support members 31D is fixed to the pump case 30D. Therefore, in the following, the description will be focused on the differences from the first embodiment. Further, the swingable connection structure will be described for only one of the elastic support members 31D and its corresponding support portion 27D1.

Referring to FIG. 8, the elastic support member 31D has a plate shape and is made of an elastically deformable material such as resin. The elastic support member 31D includes a U-shaped bent portion 31D4 that is downwardly convex. One end of the bent portion 31D4 is connected to a horizontal portion of the elastic support member 31D, which extends horizontally from the pump case 30D toward the reserve tank 27D by a predetermined distance. The other end of the bent portion 31D4 is connected to a connection portion 31D2 that is located at the tank side end portion of the elastic support member 31D. The connection portion 31D2 has a cylindrical columnar shape having a longitudinal axis 31DJ that extends in the horizontal direction. The connection portion 31D2 includes a pair of small-diameter portions 31D3 located at positions spaced away from the opposite ends of the connection portion 31D2 by a predetermined distance along the axis 31DJ. The connection portion 31D2 can be connected to the support portion 27D1 such that the elastic support member 31D can make a swinging motion with respect to the support portion 27D1 as will be hereinafter described.

The support portion 27D1 includes a first support portion 27D1*a* and a second support portion 27D1*b* that extend substantially parallel to each other from the inner circumferential surface of the reserve tank 27D toward the pump case 30D. Each of the first and second support portions 27D1*a* and 27D1*b* includes a groove portion 27D5 that is open upwardly. The first and second support portions 27D1*a* and 27D1*b* are positioned such that the small diameter portions 31D of the connection portion 31D2 can be fitted into the groove portions 27D5 of the first and second support portions 27D1*a* and 27D1*b* while the small diameter portions 31D of the connection portion 31D2 can rotate within the groove portions 27D5. In this way, the support portion 27D1 can support the elastic support member 31D such that the elastic support member 31D can make a swinging motion about the axis 31DJ (i.e., the horizontal axis) of the connection portion 31D2.

As shown in FIG. 8, the elastic support member 31D may be moved downward such that the small diameter portions 31D3 of the connection portion 31D2 are fitted into the groove portions 27D5 of the first and second support portions 27D1*a* and 27D1*b* of the support portion 27D1, whereby the elastic support member 31D (and the pump case 30D) can be positioned with respect to the Z-axis direction.

In this way, the support portion 27D1 and the connection portion 31D2 may constitute the swingable connection structure that allows a swinging motion of the elastic support member 31D with respect to the reserve tank 27D. Further, similar to the first embodiment, the swinging direction of the swingable connection structure may substantially coincide with the thickness direction of a part of the elastic support member 31D positioned proximal to the swingable connection structure. However, in this embodiment, the thickness direction of this part is a radial direction of the reserve tank 27D, and the swinging direction is a circumferential direction about the axis 31D3 of the connection portion 31D2.

Figure 9:
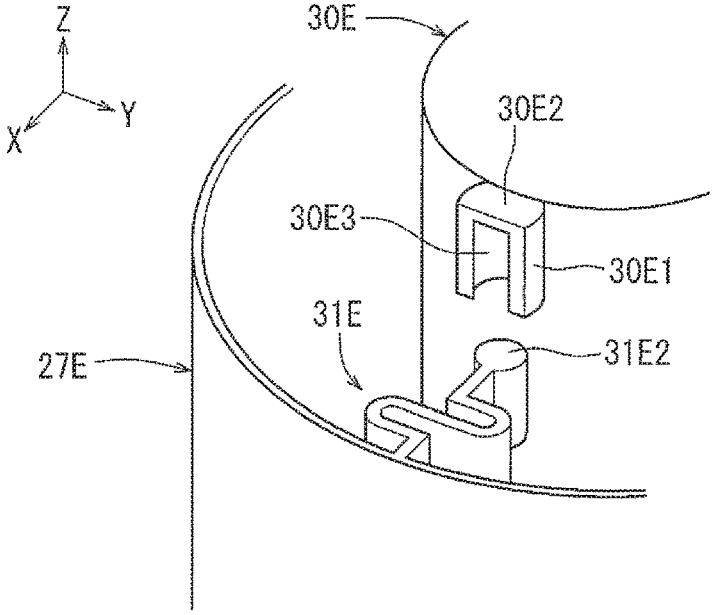
FIG. 9 is a perspective view illustrating a swingable connection structure between a pump case and a reserve tank according to a fifth embodiment.

Next, referring to FIG. 9, there is shown a swingable connection structure according to a fifth embodiment, which includes a plurality of elastic support members 31E (corresponding to the elastic support member 31 and only one elastic support member is shown in FIG. 9) for connecting between a pump case 30E (corresponding to the pump case 30) and a reserve tank 27E (corresponding to the reserve tank 27). The elastic support members 31E of the fifth embodiment are different from the elastic support member 31A shown in FIG. 2 (the first embodiment) in that the tank side end portion of each of the elastic support members 31E is fixed to the inner circumferential surface of the reserve tank 27E. Further, a plurality of support portions 30E1 (only one support portion 30E1 is shown in FIG. 9) are provided on the pump case 30E. Further, the elastic support members 31E are different from the elastic support members 31A shown in FIG. 2 (first embodiment) in that each of the elastic support members 31A has no pawl portion 31A3. However, the elastic support members 31E may be similar to the elastic support members 31A shown in FIG. 2 in that each of the elastic support members 31E includes an intermediate portion curved into an S-shape. In the following, the description will be focused on the differences from the first embodiment. Further, the swingable connection structure will be described for only one of the elastic support members 31E and its corresponding support portion 27E1.

As shown in FIG. 9, the tank side end portion of the elastic support member 31E is fixed to the inner circumferential surface of the reserve tank 27E. Further, at the case side end portion of the elastic support member 31E, there is provided a substantially cylindrical columnar connection portion 31E2 that has a longitudinal axis (central axis) extending in the Z-axis direction. The connection portion 31E2 can be connected to the support portion 30E1 such that the elastic support member 31E can make a swinging motion with respect to the support portion 30E1 as will be hereinafter described.

The support portion 30E1 is fixed to the outer circumferential surface of the pump case 30E and has a shape corresponding to a part of a cylindrical tube that has a longitudinal axis (central axis) extending in the Z-axis direction for rotatably receiving the connection portion 31E2. More specifically, the support portion 30E1 is provided with a cutout portion 30E3 opened in a radially outer direction with respect to the pump case 30E. The size of the cutout portion 30E3 is determined so as to prevent potential interference with a part of the elastic support member 31E extending from the connection portion 31E2, while allowing rotation of the connection portion 31E2 about its axis within the support portion 30E1. Further, the support portion 30E1 is provided with a cover portion 30E2 that may serve to position the connection portion 31E2 with respect to the Z-axis direction. Similar to the first embodiment, the width in the circumferential direction of the cutout portion 30E3 is set to be larger than the thickness of the elastic support member 31E. Therefore, the support portion 30E1 can support the elastic support member 31E such that the elastic support member 31E can make a swinging motion about the longitudinal axis of the support portion 30E1.

As shown in FIG. 9, the support portion 30E1 (and the pump case 30E) may be moved downward relative to the reserve tank 27E such that the connection portion 31E2 may be inserted into the support portion 30E1 from below until the upper end of the connection portion 31E2 comes into contact with the cover portion 30E2. Therefore, the pump case 30E may be positioned relative to the elastic support member 31E and the reserve tank 27E with respect to the Z-axis direction.

In this way, the support portion 30E1 and the connection portion 31E2 may constitute the swingable connection structure that allows a swinging motion of the elastic support member 31E with respect to the reserve tank 27E. Further, similar to the first embodiment, the swinging direction of the swingable connection structure may substantially coincides with the thickness direction of a part of the elastic support member 31E positioned proximal to the swingable connection structure. Further, the swinging direction is a circumferential direction about the axis of the connection portion 31E2. The range within which the elastic support member 31E can swing may be restricted by the width of the cutout portion 30E3 in the circumferential direction.

Figure 10:
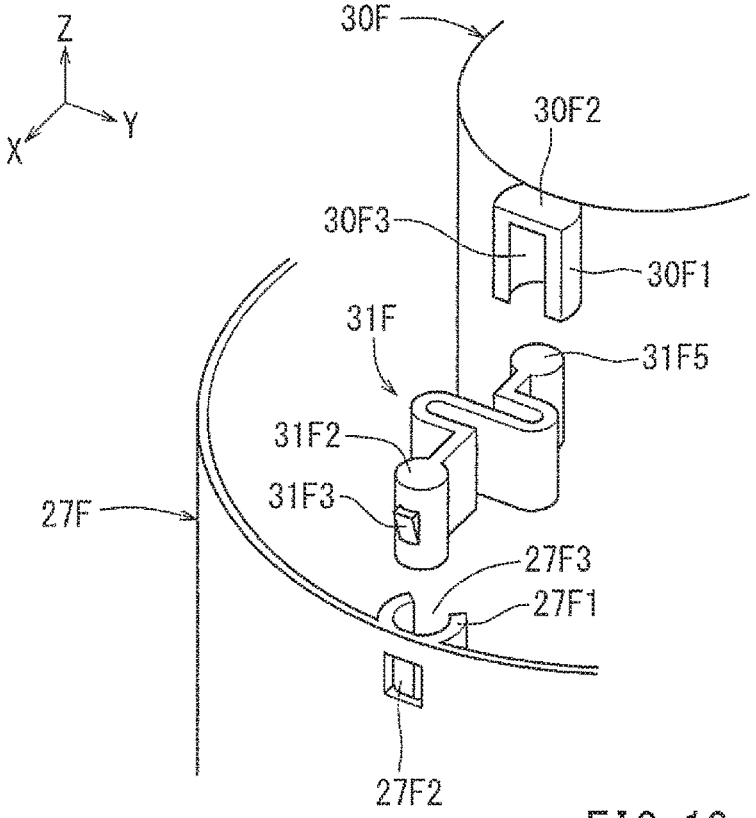
FIG. 10 is a perspective view illustrating a swingable connection structure between a pump case and a reserve tank according to a sixth embodiment.

Next, referring to FIG. 10, there is shown a swingable connection structure according to a sixth embodiment, which includes a plurality of elastic support members 31F (corresponding to the elastic support member 31 and only one elastic support member is shown in FIG. 10) for connecting between a pump case 30F (corresponding to the pump case 30) and a reserve tank 27F (corresponding to the reserve tank 27). The elastic support members 31F of the sixth embodiment are different from the elastic support member 31A shown in FIG. 2 (the first embodiment) in that the case side end portion of each elastic support member 31F is not fixed to the pump case 30F but is formed as a connection portion 31F5. Further, in this embodiment, a plurality of support portions 30F1 (only one support portion 30F1 is shown in FIG. 10) are provided on the outer circumferential surface of the pump case 30F for rotatably receiving the connection portions 31F5 of the corresponding elastic support members 31F. In this way, according to this embodiment, each of the elastic support members 31F is fixed to neither the pump case 30F nor the reserve tank 27F. However, the elastic support members 31F are similar to the elastic support members 31A shown in FIG. 2 (first embodiment) in that each of the elastic support members 31F includes an intermediate portion having an S-shaped curved shape. In the following, the description will be focused on the differences from the first embodiment. Further, the swingable connection structure will be described for only one of the elastic support members 31F and its corresponding support portions 30F1 and 27F1. The support portion 27F1 will be described later Referring to FIG. 10, the connection portion 31F5 at the case side end portion of the elastic support member 31F has a substantially cylindrical columnar shape having a longitudinal axis (central axis) extending in the Z-axis direction. The connection portion 31F5 may be configured to be the same as the connection portion 31E2 of the fifth embodiment (see FIG. 9). Therefore, the connection portion 31F5 will not be described in detail. A connection portion 31F2 is provided at the tank side end portion of the elastic support member 31F. The connection portion 31F2 has a substantially cylindrical columnar shape having a longitudinal axis (central axis) extending in the Z-axis direction. The connection portion 31F2 may be configured to be the same as the connection portion 31A2 of the first embodiment (see FIG. 2). Therefore, the connection portion 31F2 will not be described in detail. As described above, a plurality of support portions 30F1 (only one support portion 30F1 is shown in FIG. 10) are provided on the pump case 30F for rotatably receiving the connection portions 31F5 of the corresponding elastic support members 31F. In addition, in this embodiment, a plurality of support portions 27F1 (only one support portion 27F1 is shown in FIG. 10) are provided on the inner circumferential surface of the reserve tank 27F for rotatably supporting the connection portions 31F2 of the corresponding elastic support members 31F. Therefore, each of the elastic support members 31F can make a swinging motion with respect to both the support portion 30F1 and the support portion 27F1.

As shown in FIG. 10, the support portion 30F1 provided on the outer peripheral surface of the pump case 30F has a shape corresponding to a part of a substantially cylindrical tube having a longitudinal axis (central axis) extending in the Z-axis direction. The structure of the support portion 30F1 may be the same as the support portion 30E1 of the fifth embodiment (see FIG. 9). Therefore, the support portion 30F1 will not be described further in detail. Thus, the support portion 30F1 can support the elastic support member 31F such that the elastic support member 31F can make a swinging motion about the longitudinal axis of the support portion 30F1.

The support portion 27F1 provided on the inner circumferential surface of the reserve tank 27F also has a shape corresponding to a part of a substantially cylindrical tube having a longitudinal axis (central axis) extending in the Z-axis direction. The structure of the support portion 27F1 may be the same as the support portion 27A1 of the first embodiment (see FIG. 2). Therefore, the support portion 27F1 will not be described further in detail. Thus, the support portion 27F1 can support the elastic support member 31F such that the elastic support member 31F can make a swinging motion about the longitudinal axis of the support portion 27F1.

As shown in FIG. 10, the connection portion 31F5 of the elastic support member 31F may be inserted into the support portion 30F1 from below until the upper end of the connection portion 31F5 comes into contact with a cover portion 30F2 of the support portion 30F1. On the other hand, the connection portion 31F2 may be inserted into the support portion 27F1 from above until a pawl portion 31F3 provided on the outer circumferential surface of the connection portion 31F2 is fit-engaged with an opening 27F2 formed in the reserve tank 27F. Therefore, the pump case 30F can be positioned relative to the elastic support member 31F while the elastic support member 31F can be positioned with respect to the Z-axis direction relative to the reserve tank 27F.

In this way, the support portion 27F1 and the connection portion 31F2 may constitute a first swingable connection structure that allows a swinging motion of the elastic support member 31F with respect to the reserve tank 27F. Further, the support portion 30F1 and the connection portion 31F5 may constitute a second swingable connection structure that allows a swinging motion of the elastic support member 31F with respect to the pump case 30F. Similar to the first embodiment, the swinging direction of each of the first and second swingable connection structures may substantially coincide with the thickness direction of a part of the elastic support member 31F positioned proximal to the first or second swingable connection structure. Further, the swinging direction of the first swingable connection structure is a circumferential direction about the axis of the connection portion 31F2, and the swinging direction of the second swingable connection structure is a circumferential direction about the axis of the connection portion 31F5. The range within which the elastic support member 31F can swing by the first swingable connection structure may be restricted by the width of the cutout portion 27F3 in the circumferential direction, and the range within which the elastic support member 31F can swing by the second swingable connection structure may be restricted by the width of the cutout portion 30F3 in the circumferential direction. In this way, according to the sixth embodiment, opposite ends of each of the elastic support members 31F are allowed to swing about axes that are parallel to each other, so that it is possible to further mitigate the vibrations transmitted from the pump case 30F to the reserve tank 27F.

Figure 11:
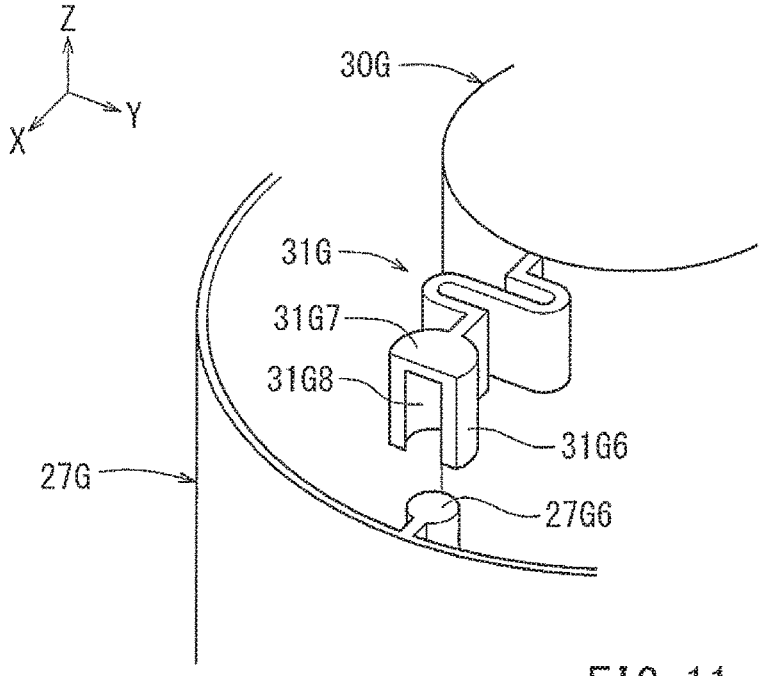
FIG. 11 is a perspective view illustrating a swingable connection structure between a pump case and a reserve tank according to a seventh embodiment.

Next, referring to FIG. 11, there is shown a swingable connection structure according to a seventh embodiment, which includes a plurality of elastic support members 31G (corresponding to the elastic support member 31 and only one elastic support member is shown in FIG. 11) for connecting between a pump case 30G (corresponding to the pump case 30) and a reserve tank 27G (corresponding to the reserve tank 27). The elastic support members 31G of this embodiment are different from the elastic support member 31A shown in FIG. 2 (the first embodiment) that in that a connection portion 31G6 of each elastic support member 31G does not have a cylindrical columnar shape but have a shape corresponding to a part of a cylindrical tube. In this connection, each of a plurality of support portions 27G6 (only one support portion 27G6 is shown in FIG. 11) for rotatably supporting the corresponding connection portion 31G6 does not have a shape corresponding to a part of a cylindrical tube but have a cylindrical columnar shape. Similar to the elastic support members 31A shown in FIG. 2 (first embodiment), the case side end portion of each of the elastic support member 31G is fixed to the pump case 30G and each of the elastic support members 31G may include an intermediate portion having an S-shaped curved configuration. In the following, the description will be focused on the differences from the first embodiment. Further, the swingable connection structure will be described for only one of the elastic support members 31G and its corresponding support portion 27G6.

As shown in FIG. 11, the case side end portion of the elastic support member 31G is fixed to the outer circumferential surface of the pump case 30G The connection portion 31G6 at the tank side end portion of the elastic support member 31G has a longitudinal axis (central axis) extending in the Z-axis direction. A cover portion 31G7 is formed at the upper end of the connection portion 31G6. A cutout portion 31G8 is formed in the connection portion 31G6 at a position on the radially outer side with respect to the pump case 30G for receiving the support portion 27G6. The cutout portion 31G8 has a predetermined width in the circumferential direction and formed so as to extend in the Z-axis direction. The size of the cutout portion 31G8 is determined so as to prevent potential interference with the support portion 27G6, while allowing rotation of the connection portion 31G6 about its axis that may coincide with the axis of the support portion 27G6. The cover portion 31G7 may serve to position the elastic support member 31G with respect the Z-axis direction relative to the support portion 27G6. The connection portion 31G6 can be connected to the support portion 27G6 such that the elastic support member 31G can make a swinging motion about the support portion 27G6 as will be hereinafter described.

As described previously, the support portion 27G6 provided on the inner circumferential surface of the reserve tank 27G has a substantially cylindrical columnar shape. The support portion 27G6 has a longitudinal axis (central axis) that extends in the Z-axis direction. The support portion 27G6 can support the elastic support member 31G such that the elastic support member 31G can make a swinging motion about the longitudinal axis of the support portion 27G6, which may coincide with the longitudinal axis of the connecting portion 31G6.

As shown in FIG. 11, the elastic support member 31G (and the pump case 30G) may be moved downward relative to the reserve tank 27G such that the support portion 27G6 of the reserve tank 27G may be inserted into the connection portion 31G6 of the elastic support member 31G until the upper end of the support portion 27G6 comes into contact with the cover portion 31G7. Therefore, the elastic support member 31G (and the pump case 30G) can be positioned relative to the reserve tank 27G with respect to the Z-axis direction.

In this way, the support portion 27G6 and the connection portion 31G6 may constitute the swingable connection structure that allows a swinging motion of the elastic support member 31G with respect to the reserve tank 27G Further, similar to the first embodiment, the swinging direction of the swingable connection structure may substantially coincide with the thickness direction of a part of the elastic support member 31G positioned proximal to the swingable connection structure. Further, the swinging direction is a circumferential direction about the axis of the connection portion 31G6. The range within which the elastic support member 31G can swing may be restricted by the width of the cutout portion 31G8 in the circumferential direction.

Figure 12:
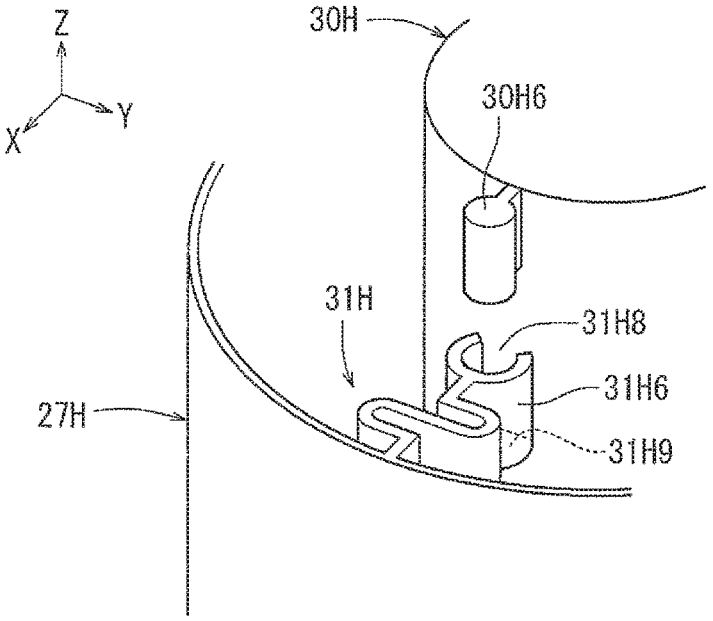
FIG. 12 is a perspective view illustrating a swingable connection structure between a pump case and a reserve tank according to an eighth embodiment.

Next, referring to FIG. 12, there is shown a swingable connection structure according to an eighth embodiment, which includes a plurality of elastic support members 31H (corresponding to the elastic support member 31 and only one elastic support member is shown in FIG. 12) for connecting between a pump case 30H (corresponding to the pump case 30) and a reserve tank 27H (corresponding to the reserve tank 27). The elastic support members 31H of this embodiment are different from the elastic support members 31A shown in FIG. 2 (the first embodiment) in that tank side end portion of each of the elastic support members 31H is fixed to the inner circumferential surface of the reserve tank 27H, and in that the case side end portion of each of the elastic support members 31H is formed as a connection portion 31H6 having a shape corresponding to a part of a cylindrical tube. A plurality of support portions 30H6 (only one support portion 30H6 is shown in FIG. 12) for connecting with the corresponding connecting portions 31H6 are provided on the outer circumferential surface of the pump case 30H. The elastic support members 31H are similar to the elastic support members 31A shown in FIG. 2 (first embodiment) in that each of the elastic support members 31H includes an intermediate portion having an S-shaped curved configuration. In the following, the description will be focused on the differences from the first embodiment. Further, the swingable connection structure will be described for only one of the elastic support members 31H and its corresponding support portion 30H6.

As described above, the tank side end portion of the elastic support member 31H is fixed to the inner circumferential surface of the reserve tank 27H. The connection portion 31H6 formed at the case side end portion of the elastic support member 31H has a shape of a part of a cylindrical tube having a longitudinal axis (central axis) extending in the Z-direction. At the lower end of the connection portion 31H6, there is provided a bottom portion 31H9. A cutout portion 31H8 is formed in the connection portion 31H6 at a position on the radially inner side with respect to the reserve tank 27H for receiving the support portion 30H6. The cutout portion 31H8 has a predetermined width in the circumferential direction and extends in the Z-axis direction. The size of the cutout portion 31H8 is determined so as to prevent potential interference with the support portion 30H6, while allowing rotation of the connection portion 31H6 about the support portion 30H6. The bottom portion 31H9 serves to position the support portion 30H6 with respect to the Z-axis direction. The connection portion 31H6 can be connected to the support portion 30H6 such that the elastic support member 31H can make a swinging motion with respect to the support portion 30H6.

The support portion 30H6 provided on the outer circumferential surface of the pump case 30H has a substantially cylindrical columnar shape having a longitudinal axis (central axis) extending in the Z-axis direction. The support portion 30H6 can support the elastic support member 31H such that it can make a swinging motion about the axis of the support portion 30H6, which coincides with the axis of the connection portion 31H6.

As shown in FIG. 12, the support portion 30H6 (and the pump case 30H) may be moved downward such that the support portion 30H6 may be inserted into the connection portion 31H6 of the elastic support member 31H from above until the lower end of the support portion 30H6 comes into contact with the bottom portion 31H9. Therefore, the support portion 30H6 (and the pump case 30H) can be positioned in the Z-axis direction with respect to the reserve tank 27H.

In this way, the support portion 30H6 and the connection portion 31H6 may constitute the swingable connection structure that allows a swinging motion of the elastic support member 31H with respect to the pump case 30H. Further, similar to the first embodiment, the swinging direction of the swingable connection structure may substantially coincide with the thickness direction of a part of the elastic support member 31H positioned proximal to the swingable connection structure. Further, the swinging direction is a circumferential direction about the axis of the connection portion 31H6. The range within which the elastic support member 31H can swing may be restricted by the width of the cutout portion 31H8 in the circumferential direction.

Figure 13:
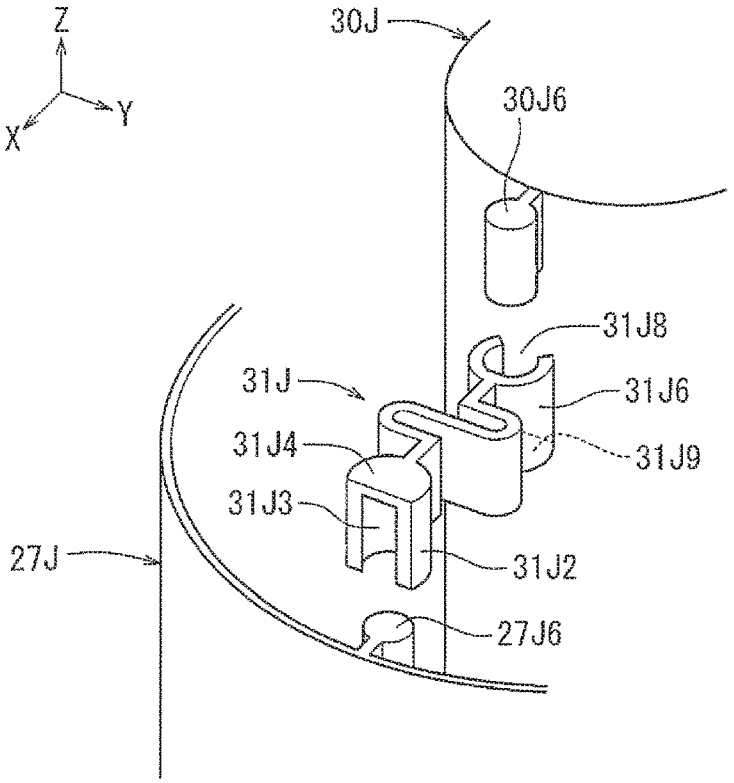
FIG. 13 is a perspective view illustrating a swingable connection structure between a pump case and a reserve tank according to a ninth embodiment.

Next, referring to FIG. 13, there is shown a swingable connection structure according to a ninth embodiment, which includes a plurality of elastic support members 31J (corresponding to the elastic support member 31 and only one elastic support member is shown in FIG. 13) for connecting between a pump case 30J (corresponding to the pump case 30) and a reserve tank 27J (corresponding to the reserve tank 27). The elastic support members 31J of this embodiment are different from the elastic support members 31A shown in FIG. 2 (the first embodiment) in that the case side end portion of each of the elastic support members 31J is formed as a connection portion 31J6 having a shape corresponding to a part of a cylindrical tube, and in that the tank side end portion of the elastic support member 31J is formed as a connection portion 31J2 having a shape substantially corresponding to a part of a cylindrical tube. A plurality of support portions 30J6 (only one support portion 30J6 is shown in FIG. 13) are provided on the outer circumference of the pump case 30J. Each of the support portions 30J6 is configured to have a cylindrical columnar shape for rotatably receiving the corresponding connection portion 31J6. Further, a plurality of support portions 27J6 (only one support portion is shown in FIG. 13) are provided on inner circumference of the reserve tank 27J. Each of the support portions 27J6 is configured to have a cylindrical columnar shape for rotatably receiving the corresponding connection portion 31J2. In this way, the elastic support member 31J is fixed to none of the pump case 30J and the reserve tank 27J. The elastic support member 31J is similar to the elastic support member 31A shown in FIG. 2 (first embodiment) in that it includes an intermediate portion having an S-shaped curved configuration. In the following, the description will be focused on the differences from the first embodiment. Further, the swingable connection structure will be described for only one of the elastic support members 31J and its corresponding support portions 30J6 and 27J6.

The connection portion 31J6 provided at the case side end portion of the elastic support member 31J has a longitudinal axis (central axis) extending in the Z-axis direction. Similarly, the connection portion 31J6 provided at the tank side end portion has a longitudinal axis (central axis) extending in the Z-axis direction. The connection portion 31J6 may be configured to be similar to the connection portion 31H6 of the eighth embodiment (see FIG. 12). Therefore, the connection portion 31J6 will not be described in detail. The connection portion 31J2 formed at the tank side end portion of the elastic support member 31J has a longitudinal axis (central axis) extending in the Z-axis direction. The connection portion 31J2 may be configured to be similar to the connection portion 31G6 of the seventh embodiment (see FIG. 11). Therefore, the connection portion 31J2 will not be described in detail. The connection portion 31J2 can be connected to the support portion 27J6 such that the elastic support member 31J can make a swinging motion with respect to the support portion 27J6. The connection portion 31J6 can be connected to the support portion 30J6 such that the elastic support member 31J can make a swinging motion with respect to the support portion 30J6.

The support portion 30J6 provided on the outer circumferential surface of the pump case 30J has a longitudinal axis (central axis) extending in the Z-axis direction. The structure of the support portion 30J6 may be similar to the support portion 30H6 of the eighth embodiment (see FIG. 12), and therefore, the support portion 30J6 will not be described in detail. The support portion 30J6 can support the elastic support member 31J such that the elastic support member 31J can make a swinging motion about the axis of the support portion 30J6, which may coincide with the axis of the connection portion 31J6.

The support portion 27J6 provided on the inner circumferential surface of the reserve tank 27J has a longitudinal axis (central axis) extending in the Z-axis direction. The structure of the support portion 27J6 may be similar to the support portion 27G6 of the seventh embodiment (see FIG. 11), and therefore, the support portion 27J6 will not be described in detail. The support portion 27J6 can support the elastic support member 31J such that the elastic support member 31J can make a swinging motion about the axis of the support portion 27J6, which may coincides with the axis of the connection portion 31J2.

As shown in FIG. 13, the elastic support member 31J may be moved downward relative to the reserve tank 27J such that the support portion 27J6 may be inserted into the connection portion 31J2 from below until the upper end of the support portion 27J6 comes into contact with a cover portion 31J4 of the connection portion 31J2. In this way, the elastic support member 31J may be positioned with respect to the Z-axis direction relative to the reserve tank 27J. Further, the support portion 30J6 (and the pump case 30J) may be moved downward such that the support portion 30J6 may be inserted into the connection portion 31J6 from above until the lower end of the support portion 30J6 comes into contact with a bottom portion 31J9 of the connection portion 31J6. Therefore, the pump case 30J can be positioned with respect to the Z-axis direction relative to the elastic support member 31J and relative to the reserve tank 27J.

In this way, the support portion 27J6 and the connection portion 31J2 may constitute a first swingable connection structure that allows a swinging motion of the elastic support member 31J with respect to the reserve tank 27J. Further, the support portion 30J6 and the connection portion 31J6 may constitute a second swingable connection structure that allows a swinging motion of the elastic support member 31J with respect to the pump case 30J. Similar to the first embodiment, the swinging direction of each of the first and second swingable connection structures may substantially coincides with the thickness direction of a part of the elastic support member 31J positioned proximal to the first or second swingable connection structure. Further, the swinging direction of the first swingable connection structure is a circumferential direction about the axis of the connection portion 31J2, and the swinging direction of the second swingable connection structure is a circumferential direction about the axis of the connection portion 31J6. The range within which the elastic support member 31J can swing by the first swingable connection structure may be restricted by the width of a cutout portion 31J3 of the connection portion 31J2 in the circumferential direction, and the range within which the elastic support member 31J can swing by the second swingable connection structure may be restricted by the width of the cutout portion 31J8 of the connection portion 31J6 in the circumferential direction. In this way, according to the ninth embodiment, opposite ends of the elastic support member 31J are allowed to swing about axes that are parallel to each other, so that it is possible to further mitigate the vibrations transmitted from the pump case 30J to the reserve tank 27J.

Figure 14:
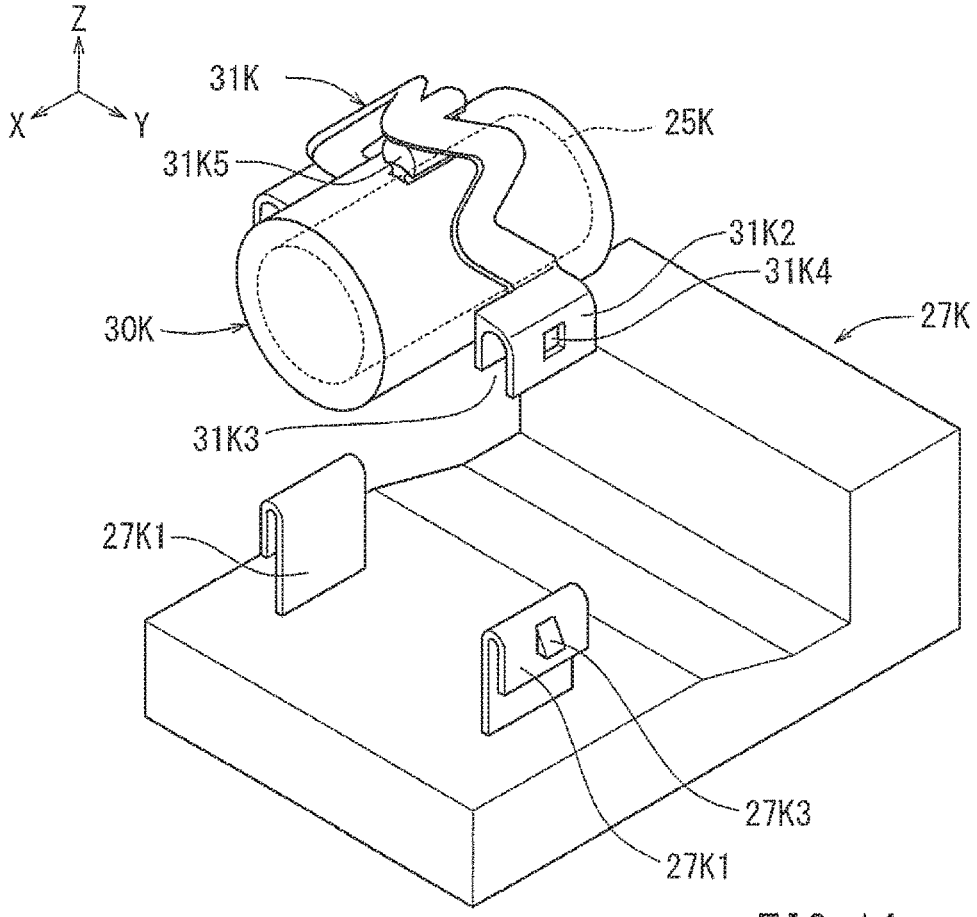
FIG. 14 is a perspective view illustrating a pump case, a reserve tank, and an elastic support member according to a tenth embodiment.
Figure 15:
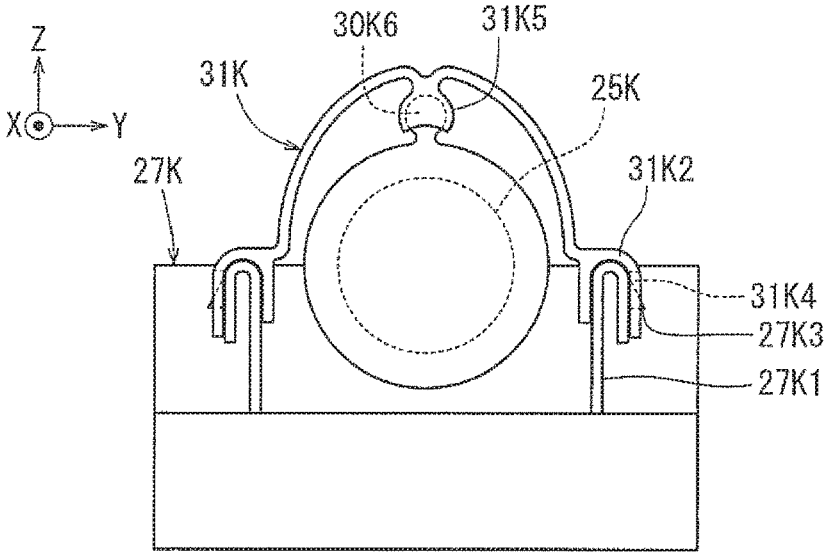
FIG. 15 is a perspective view illustrating a swingable connection structure between a pump case and a reserve tank according to a tenth embodiment.

Next, referring to FIGS. 14 and 15, there is shown a swingable connection structure according to a tenth embodiment, which includes an elastic support members 31K for connecting between a pump case 30K (corresponding to the pump case 30) and a reserve tank 27K (corresponding to the reserve tank 27). In this embodiment, the axis of the pump case 30K accommodating a fuel pump 25K is not parallel to the Z-axis direction but extends in the horizontal direction (more specifically, the X-axis direction as shown in FIGS. 14 and 15). Further, the reserve tank 27K is not configured to receive the pump case 30K therein but is arranged below the pump case 30K. More specifically, the reserve tank 27K does not have a cylindrical tubular shape but has a shape like an L-shaped box. Similar to the elastic support member 31A of the first embodiment, the elastic support member 31K may elastically support the pump case 30K with respect to the reserve tank 27K. Further, the elastic support member 31A may have a connection portion 31K5 for connection with the pump case 30K and a pair of connection portions 31K2 for connection with the reserve tank 27K. Although not shown in FIGS. 14 and 15, the reserve tank 27K may be connected to a flange unit (similar to the flange unit 15 shown in FIG. 1) via connection mechanisms (similar to the connection mechanisms 42 shown in FIG. 1). In the following, the description will be focused on the differences from the first embodiment.

The elastic support member 31K may be made of an elastic material such as resin and may be formed to have a plate-shape that is curved in the thickness direction as it extends along the outer circumferential surface of the pump case 30K. More specifically, the elastic support member 31K has opposite ends in the circumferential direction, which are formed as the connection portions 31K2 and a central portion in the circumferential direction, which includes the connection portion 31K5. The intermediate portion between the connection portion 31K5 and each of the connection portions 31K2 is curved along the circumferential surface of the pump case 30K and is bent into an S-shape in the axial direction of the pump case 30K. The connection portion 31K5 is formed on the lower side of the central portion (uppermost portion) of the elastic support member 31K and has a shape substantially corresponding to a cylindrical columnar shape. The connection portion 31K may be formed to have a substantially spherical space that corresponds to a part of a sphere and is opened downwardly toward the outer circumferential surface of the pump case 30K. Each of the connection portions 31K2 provided at opposite ends (lower ends in FIGS. 14 and 15) of the elastic support member 31K has an inverted U-shape and has an opening 31K3 oriented downward for connection with corresponding one of a pair of support portions 27K1 provided on the reserve tank 27K, which will be explained later. Further, each connection portion 31K2 is provided with an opening 31K4 for fitting with a pawl portion 27K3 of the corresponding support portion 27K1. The connection portion 31K5 can be connected to a support portion 30K6 provided on the pump case 30K such that the elastic support member 31K can make a swinging motion about the support portion 30K6 as will be explained later.

The pump case 30K has a substantially cylindrical tubular shape for accommodating the fuel pump 25K and has a longitudinal axis (central axis) extending in the horizontal direction (the X-axis direction in FIG. 14). The support portion 30K6 is provided on the pump case 30K at the upper end of the pump case 30K and is disposed at a substantially central position with respect to the axial direction of the pump case 30K, so that the support portion 30K6 is positioned directly above the center of gravity of the pump case 30K that accommodates the fuel pump 25K. The support portion 30K6 has a shape corresponding to a part of sphere and is upwardly convex, so that the support portion 30K6 can be received within the spherical space of the of the connection portion 31K5. In this way, the support portion 30K6 can support the elastic support member 31K such that the elastic support member 31K can make a swinging motion about the center of the support portion 30K6 that coincides with the center of the spherical space of the connection portion 31K5. The size of the connection portion 31K5, more specifically, the distance of the center of the spherical space and the lower end of the connection portion 31K5, where the spherical space is opened, may be suitably determined such that the support portion 30K6 can be fitted into the spherical space by utilizing the elastic deformation of the lower end portion of the connection portion 31K5 and such that the connection portion 31K5 can support in a suspended manner the support portion 30K6 together with the pump case 30K accommodating the fuel pump 25K. Alternatively, for example, the spherical space of the connection portion 31K5 may have a hemispherical shape, and a retainer member (not shown) may be attached to the lower end of the connection portion 31K5 for supporting the support portion 30K6 from below and preventing removal of the support portion 30K6 from the connection portion 31K5.

Each of the support portions 27K1 provided on the reserve tank 27K has a substantially inverted U-shape and protrudes upward from the reserve tank 27K. The pawl portion 27K3 is provided on one side of the support portion 27K1 for fitting with the opening 31K4 of the corresponding connection portion 31K2. The height, i.e., the horizontally protruding distance, of the pawl portion 27K3 gradually increases in the downward direction. It should be noted that the configuration of the reserve tank 27K may not be limited to that shown in FIGS. 14 and 15.

As shown in FIG. 14, the support portion 30K6 of the pump case 30K may be fitted into the connection portion 31K5 of the elastic support member 31K from below, and the connection portions 31K2 of the elastic support member 31K may be fit-engaged with the corresponding support portions 27K1 of the reserve tank 27K. In this way, the pump case 30K may be positioned with respect to the reserve tank 27K while the elastic support member 31K elastically supports the pump case 30K with respect to the reserve tank 27K. Because the pawl portions 27K3 of the support portions 27K1 provided on reserve tank 27K are respectively fit-engaged with the openings 31K4 of the connection portions 31K2 provided on the elastic support member 31K, it may be possible to prevent the connection portions 31K2 from being accidentally detached from the support portions 27K1.

In this way, the support portion 30K6 and the connection portions 31K3 may constitute a swingable connection structure that allows a swinging motion of the elastic support member 31K with respect to the reserve tank 27K. Further, the support portion 30K6 of the pump case 30K is connected to the connection portion 31K5 of the elastic support member 31K in a manner like a ball joint. Therefore, even in the case where the pump case 30K vibrates in the horizontal direction with respect to the elastic support member 31K, the connection portion 31K5 can make a swinging motion with respect to the support portion 30K6. Thus, it is possible to further mitigate vibrations transmitted from the pump case 30K to the reserve tank 27K. Although the ball-joint like connection structure is provided between the elastic support member 31K and the pump case 30K in this embodiment, a similar ball-joint connection structure can be used for connecting between the elastic support member 31K and the reserve tank 27K in place of or in addition to the ball-joint like connection structure between the elastic support member 31K and the pump case 30K.

The above embodiments may be modified in various ways. For example, although the above embodiments are applied to the fuel supply device of a vehicle such as an automobile or a motorcycle, the above teachings may be also applied to a fuel supply device used for a ship, an industrial machine or the like.

Further, in the above-described embodiments, various structural examples have been shown regarding the swingable connection structure between the elastic support member and the pump case and/or the swingable connection structure between the elastic support member and the reserve tank. It should be noted that the swingable connection structure may be provided between the elastic support member and the pump case and/or between the elastic support member and the reserve tank. Further, the swingable connection structure between the support portion and the connection portion may not be limited to those described in the above embodiments but may be modified in various way as long as the support portion and the connection portion can rotate (pivot or swing) relative to each other.

Further, although the connection portion(s) of the elastic support member of each of the above embodiments is(are) formed integrally with the elastic support member, the connection portion(s) may be formed as a separate member(s) from the elastic support member and may be fixedly attached to or joined thereto. Similarly, although the support portion(s) provided on the pump case (or reserve tank) for connection with the elastic support member is(are) formed integrally with the pump case (or reserve tank), the support portion(s) may be formed as a separate member(s) from the pump case (or the reserve tank) and may be fixedly attached or joined to the pump case (or reserve tank).

What is claimed is:

1. A fuel supply device comprising:

a pump case configured to accommodate a fuel pump;

a reserve tank; and an elastic support device configured to elastically support the pump case with respect to the reserve tank; wherein:

the elastic support device comprises:

an elastic support member extending between the pump case and the reserve tank in a radial direction with respect to a central axis of the fuel pump;

a connection device including a connection portion disposed at the elastic support member and a support portion disposed at one of either the pump case or the reserve tank, the connection device configured to connect the elastic support member between the pump case and the reserve tank; and one of the connection portion and the support portion is configured to partially surround the other of the connection portion and the support portion;

wherein the connection device is further configured to swingably connect the elastic support member to at least one of the pump case and the reserve tank.

2. The fuel supply device according to claim 1, wherein:

the connection device comprises:

a first connection device configured to connect a first portion of the elastic support member to the pump case; and a second connection device configured to connect a second portion of the elastic support member to the reserve tank; and the first connection device is further configured to connect the first portion of the elastic support member to the pump case such that the first portion is swingable relative to the pump case about a swinging axis.

3. The fuel supply device according to claim 2, wherein:

the elastic support member has a plate shape and has a thickness direction; and the swinging axis is substantially perpendicular to the thickness direction of the elastic support member at the first portion.

4. The fuel supply device according to claim 3, wherein:

the elastic support portion has an intermediate portion between the first portion and the second portion; and the intermediate portion is bent in the thickness direction thereof.

5. The fuel supply device according to claim 2, wherein:

the first connection device comprises a connection portion disposed at the first portion of the elastic support member and a support portion disposed at the pump case;

one of the connection portion and the support portion comprises a substantially cylindrical columnar portion; and the other of the connection portion and the support portion comprises a substantially cylindrical hole for rotatably receiving the substantially cylindrical columnar portion about the swinging axis.

6. The fuel supply device according to claim 5, wherein:

the swinging axis is substantially parallel to a longitudinal axis of the pump case.

7. The fuel supply device according to claim 2, wherein:

the first connection device comprises a connection portion disposed at the first portion of the elastic support member and a support portion disposed at the pump case;

one of the connection portion and the support portion comprises a substantially cylindrical columnar portion; and the other of the connection portion and the support portion comprises a groove having a shape substantially corresponding to a part of a cylindrical hole for rotatably receiving the substantially cylindrical columnar portion about the swinging axis.

8. The fuel supply device according to claim 7, wherein:

the swinging axis is substantially perpendicular to a longitudinal axis of the pump case.

9. The fuel supply device according to claim 2, wherein:

the first connection device is further configured to detachably connect the first portion of the elastic support member to the pump case.

10. The fuel supply device according to claim 2, wherein:

the first connection device is further configured to swingably connect the first portion of the elastic support member to the pump case about a point.

11. The fuel supply device according to claim 1, wherein:

the connection device comprises:

a first connection device configured to connect a first portion of the elastic support member to the pump case; and a second connection device configured to connect a second portion of the elastic support member to the reserve tank; and the second connection device is further configured to connect the second portion of the elastic support member to the reserve tank such that the second portion is swingable relative to the reserve tank about a swinging axis.

12. The fuel supply device according to claim 11, wherein:

the elastic support member has a plate shape and has a thickness direction; and the swinging axis is substantially perpendicular to the thickness direction of the elastic support member at the second portion.

13. The fuel supply device according to claim 12, wherein:

the elastic support portion has an intermediate portion between the first portion and the second portion; and the intermediate portion is bent in the thickness direction thereof.

14. The fuel supply device according to claim 11, wherein:

the second connection device comprises a connection portion disposed at the second portion of the elastic support member and a support portion disposed at the reserve tank;

one of the connection portion and the support portion comprises a substantially cylindrical columnar portion; and the other of the connection portion and the support portion comprises a substantially cylindrical hole for rotatably receiving the substantially cylindrical columnar portion about the swinging axis.

15. The fuel supply device according to claim 14, wherein:

the swinging axis is substantially parallel to a longitudinal axis of the pump case.

16. The fuel supply device according to claim 11, wherein:

the second connection device comprises a connection portion disposed at the second portion of the elastic support member and a support portion disposed at the reserve tank;

one of the connection portion and the support portion comprises a substantially cylindrical columnar portion; and the other of the connection portion and the support portion comprises a groove having a shape substantially corresponding to a part of a cylindrical hole for rotatably receiving the substantially cylindrical columnar portion about the swinging axis.

17. The fuel supply device according to claim 16, wherein:

the swinging axis is substantially perpendicular to a longitudinal axis of the pump case.

18. The fuel supply device according to claim 11, wherein:

the second connection device is further configured to detachably connect the second portion of the elastic support member to the reserve tank.

19. The fuel supply device according to claim 11, wherein:

the second connection device is further configured to swingably connect the second portion of the elastic support member to the reserve tank about a point.

20. The fuel supply device according to claim 1, wherein:

the elastic support member includes a first end on the side of the pump case and a second end on the side of the reserve tank;

the connection device comprises a first connection device and a second connection device, the first connection device being configured to connect the first end of the elastic support member to the pump case, and the second connection device being configured to connect the second end of the elastic support member to the reserve tank; and the first connection device swingably connects the first end of the elastic support member to the pump case.

21. The fuel supply device according to claim 1, wherein:

the elastic support member includes a first end on the side of the pump case and a second end on the side of the reserve tank;

the connection device comprises a first connection device and a second connection device, the first connection device being configured to connect the first end of the elastic support member to the pump case, and the second connection device being configured to connect the second end of the elastic support member to the reserve tank; and the second connection device swingably connects the second end of the elastic support member to the reserve tank.

22. A fuel supply device comprising:

a pump case configured to accommodate a fuel pump;

a reserve tank; and an elastic support device configured to elastically support the pump case with respect to the reserve tank; wherein:

the elastic support device comprises:

an elastic support member extending between the pump case and the reserve tank in a radial direction with respect to a central axis of the fuel pump; and a first connection device including a first connection portion disposed at a first portion of the elastic support member and a first support portion disposed at the pump case, the first connection device configured to swingably connect the first portion of the elastic support member to the pump case about a first axis;

one of the first connection portion and the first support portion is configured to partially surround the other of the first connection portion and the first support portion about the first axis;

a second connection device including a second connection portion disposed at the second portion of the elastic support member and a second support portion disposed at the pump case, the second connection device configured to swingably connect a second portion of the elastic support member to the reserve tank about a second axis; and one of the second connection portion and the second support portion is configured to partially surround the other of the second connection portion and the second support portion about the second axis;

wherein the first axis and the second axis are substantially parallel to each other.

* * * * *